US005135059A

United States Patent [19]

Turner et al.

[11] Patent Number: 5,135,059

[45] Date of Patent: Aug. 4, 1992

[54] BOREHOLE DRILLING MOTOR WITH FLEXIBLE SHAFT COUPLING

[75] Inventors: William E. Turner, Middlefield; Peter R. Harvey, Hartford, both of Conn.

[73] Assignee: Teleco Oilfield Services, Inc., Meriden, Conn.

[21] Appl. No.: 615,602

[22] Filed: Nov. 19, 1990

[51] Int. Cl.[5] ..... E21B 4/00

[52] U.S. Cl. ..... 175/101; 175/107

[58] Field of Search ..... 177/74, 76, 101, 107, 177/325

[56] References Cited

U.S. PATENT DOCUMENTS

| | | | |
|---|---|---|---|
| 2,028,407 | 1/1936 | Moineau . | |
| 3,260,069 | 7/1966 | Neilson et al. | 464/19 X |
| 3,307,486 | 3/1967 | Lindberg . | |
| 3,567,348 | 3/1971 | Benson | 418/48 |
| 3,840,080 | 10/1974 | Berryman | 175/107 |
| 3,912,426 | 10/1975 | Tschirky | 175/107 X |
| 3,939,670 | 2/1976 | Amtsberg | 464/20 |
| 3,982,858 | 9/1976 | Tschirky | 175/107 X |
| 3,999,901 | 12/1976 | Tschirky | 175/107 X |
| 4,051,910 | 10/1977 | Clark | 175/107 X |
| 4,059,165 | 11/1977 | Clark | 175/107 |
| 4,137,975 | 2/1977 | Pennock | 175/107 X |
| 4,143,722 | 3/1979 | Driver | 175/107 X |
| 4,157,022 | 6/1979 | Crase | 464/117 |
| 4,187,061 | 2/1980 | Jiirgens | 175/107 X |
| 4,256,191 | 3/1981 | Jones | 175/107 X |
| 4,263,788 | 4/1981 | Beimgraben | 464/19 X |
| 4,311,443 | 1/1982 | Clark et al. . | |
| 4,339,007 | 7/1982 | Clark | 175/107 |
| 4,397,619 | 9/1983 | Alliquander et al. . | |
| 4,441,565 | 4/1984 | Licjekuist | 175/325 |
| 4,518,049 | 5/1985 | Baldenko et al. | 175/107 |
| 4,562,560 | 12/1985 | Kamp | 367/83 |
| 4,567,953 | 2/1986 | Baldenko et al. | 175/107 |
| 4,613,002 | 9/1986 | Pittman | 175/107 |
| 4,632,193 | 12/1986 | Geczy | 166/301 X |
| 4,646,856 | 3/1987 | Dismukes | 175/107 |
| 4,679,638 | 7/1987 | Eppink | 175/107 |
| 4,775,017 | 10/1988 | Forrest | 175/107 X |
| 4,823,889 | 4/1989 | Baldenko et al. | 175/107 |
| 4,828,053 | 5/1989 | Maurer et al. | 175/75 |
| 4,842,059 | 6/1989 | Tomek | 166/65.1 |
| 4,844,180 | 7/1989 | Zijsling | 175/107 |
| 4,875,531 | 10/1989 | Bieh et al. | 175/107 X |
| 4,890,682 | 1/1990 | Worrall | 175/107 X |
| 4,909,337 | 3/1990 | Kochnev et al. | 418/48 X |
| 4,932,482 | 6/1990 | De Lucia | 175/107 X |
| 4,991,668 | 2/1991 | Rehm et al. | 175/75 X |
| 5,022,471 | 6/1991 | Maurer et al. | 175/75 |

*Primary Examiner*—Ramon S. Britts
*Assistant Examiner*—Roger J. Schoeppel
*Attorney, Agent, or Firm*—Fishman, Dionne & Cantor

[57] ABSTRACT

A downhole drilling motor includes a rotor and stator of the Moineau positive displacement type within a housing. A drive shaft is rotatably mounted within the housing. A flexible shaft with a polygonal connection at each end transmits the rotational motion of the rotor to the drive shaft while compensating for the eccentric movement of said rotor within said stator relative to said drive shaft.

18 Claims, 5 Drawing Sheets

BOREHOLE DRILLING MOTOR WITH FLEXIBLE SHAFT COUPLING

Technical Field

The invention relates to downhole drilling motors and more particularly to hydraulic downhole drilling motors.

BACKGROUND OF THE INVENTION

Drilling devices wherein a drill bit is rotated by a downhole motor, e.g. A positive displacement fluid motor, are well known. A positive displacement type motor includes a housing, a stator having a helically contoured inner surface secured within the housing and a rotor having a helically contoured exterior surface disposed within the stator. As drilling fluid or "mud" is pumped through the stator, the rotor is rotated within the stator and also orbits around the internal surface of the stator in a direction opposite the direction of rotation. The rotor is connected to a rotatable drive shaft through a flexible coupling to compensate for the eccentric movement of the rotor.

The application of flexible couplings to positive displacement motors for downhole drilling is very challenging due to an extremely corrosive and erosive operating environment and constraints on length and diameter in view of the very heavy loads that must be transmitted. Conventional flexible coupling designs use moving parts, e.g. universal joints of the type described in U.S. Pat. No. 3,260,069 (Nielson et al), to compensate for eccentric movement of the rotor and for shaft misalignment. Jointed flexible couplings provide a short service life in downhole applications, due to severe wear problems associated with the moving parts of such couplings.

Moineau motors in which a flexible connection between a drive shaft and rotor are provided by a flexible shaft, rather than jointed rigid members are described in U.S. Pat. No. 2,028,407 (Moineau) and U.S. Pat. No. 4,679,638 (Eppink). Moineau provides no guidance as to how to secure a flexible shaft to a rotor and to a drive shaft in a manner which will withstand the severe thrust, torsion and bending loads encountered in downhole motor application. Eppink describes one approach to interconnecting the rotor, flexible shaft and drive shaft in the form of a tapered threaded fittings and a pin (element 61 of Eppink). Threaded connections and pinned connections introduce stress concentrations into the flexible coupling which can give rise to fatigue failures and thereby compromise the service life of the coupling. Components of the shaft assembly described by Eppink are not interchangeable and the entire assembly must be replaced if one of the components of the assembly fails.

SUMMARY OF THE INVENTION

A downhole drilling motor is disclosed. The motor includes a housing, a stator secured within the housing and having a helically contoured inner surface, a rotor disposed within said housing and having a helically contoured external surface, a drive shaft rotatably mounted within the housing and a flexible shaft for connecting the drive shaft to the rotor and allowing eccentric movement of the rotor within the stator. The flexible shaft includes polygonal ends which are received within polygonal sockets on the rotor and drive shaft, respectively, to interconnect the rotor, flexible shaft and drive shaft, The flexible shaft of the present invention provides an infinite projected fatigue life.

In a preferred embodiment the rotor defines an internal bore extending from an open end of said rotor to a closed end of said rotor, the polygonal socket is defined by the closed end of the rotor and the flexible shaft is received within the bore of the rotor.

In another embodiment of the present invention, the housing is a "bent" housing and includes a tubular first portion extending along a first longitudinal axis, a tubular second portion extending along a second longitudinal axis and a transitional portion connecting the first and second portions. The first and second axes are noncolinear and intersect within the transitional portion. A stator is secured within the first portion of the housing, a rotor is disposed with the stator, a drive shaft is rotatably mounted within the second portion of the housing and a flexible shaft connects the rotor with the output shaft and allows eccentric movement of the rotor within the stator.

DETAILED DESCRIPTION OF THE INVENTION

Figure 1:
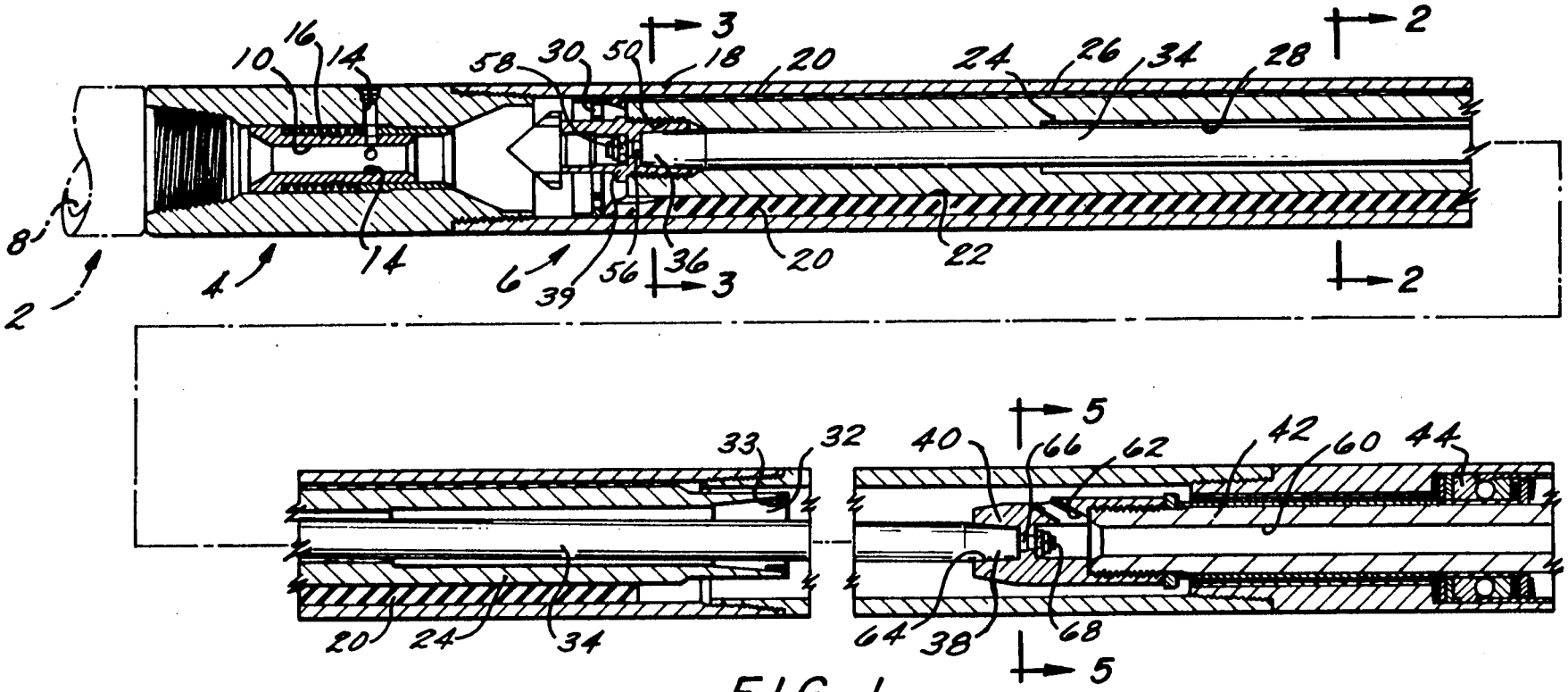
FIG. 1 shows a longitudinal cross sectional view of a downhole drilling motor of the present invention.
Figure 2:
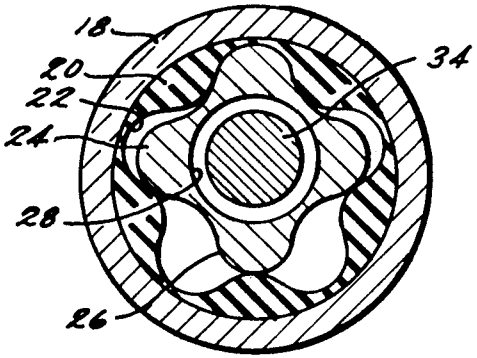
FIG. 2 shows a transverse cross sectional view taken along line 2—2 in FIG. 1.

Referring to FIGS. 1 and 2, the lower end of a drillstring 2 is connected to a bypass valve 4. The bypass valve 4 is connected to the uphole end of the drilling motor 6 of the present invention. A drill bit (not shown) is connected to the downhole end of the drilling motor 6.

Drilling fluid is pumped through the bore 8 of drillstring 2 to bore 10 of bypass valve 4. Drilling fluid is allowed to enter or escape from the bore 10 of valve 4 through bypass ports 14 as the drillstring 2 is being put into or removed from a borehole. When the drill bit bottoms out in the borehole, shuttle 16 closes bypass ports 14 so that the drilling fluid is directed to the drilling motor 6.

The motor 6 includes a housing 18 and a stator 20 secured within the housing 18. The stator 20 has a helically contoured inner surface 22. A rotor 24 is disposed within the stator 20. The rotor 24 has a helically contoured outer surface 26 and an internal bore 28 extending from an uphole end 30 of the rotor 24 to an open downhole end 32 of the rotor.

As discussed more fully below, the housing 18 is bent at a point along its length. A housing suitable for the drilling motor of the present invention may be bent at an angle of up to 3°.

A flexible shaft 34 extends from an uphole end 36 to a downhole end 38. The uphole end 36 of shaft 34 is received within the bore 28 of rotor 24 and secured to rotor tail shaft 39 which is in turn secured to uphole end 30 of rotor 24.

The bore 28 is stepped so that the internal diameter of the bore 28 becomes progressively wider as it approaches the downhole end 32 of the rotor to allow deflection of the shaft 34 within the bore 28.

An elastomeric ring 33 is secured within the bore 28 at the downhole end 32 of the rotor to prevent contact of the shaft 34 with the inner surface of bore 28. The ring 33 effectively raises the natural frequency of the shaft 34 by limiting the deflection of the middle portion of the shaft 34.

The downhole end 38 of flexible shaft 34 is secured to cap 40 which is in turn secured to drive shaft 42. Drive shaft 42 is rotatably mounted in housing 18 and supported by bearings 44.

Preferably, the flexible shaft 34 comprises 4140 alloy steel, beryllium copper or a composite material.

Suitable composite materials include fiber reinforced polymer matrix composite materials. Suitable reinforcing fibers comprise carbon fibers, glass fibers and combinations of glass fibers and carbon fibers. Epoxy resins are preferred as the polymer matrix of the composite material. Preferably, the composite shaft is made of conventional filament winding composite fabrication techniques.

Figure 3:
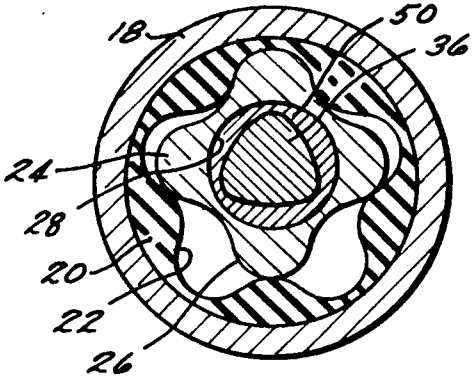
FIG. 3 shows a transverse cross sectional view taken along line 3—3 on FIG. 1.

Referring to FIGS. 1 and 3, the uphole end 30 of rotor 24 defines a threaded socket 50 in which rotor tail shaft 39 is threadably secured. The uphole end 36 of flexible shaft 34 comprises a three lobed male polygon. The uphole end 36 of flexible shaft 34 is received within a corresponding three lobed polygonal socket 54 in rotor tail shaft 39. The flexible shaft 34 is secured to rotor tail shaft 39 by threaded extension 56 and nut 58.

Figure 4:
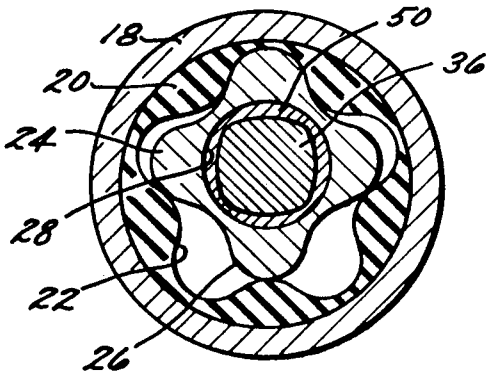
FIG. 4 shows an alternative embodiment of the connection shown in FIG. 3.

FIG. 4 shows an alternative embodiment in which the uphole end 36 of shaft 30 comprises a four lobed male polygon and socket 54 comprises a corresponding four lobed polygonal socket.

Figure 5:
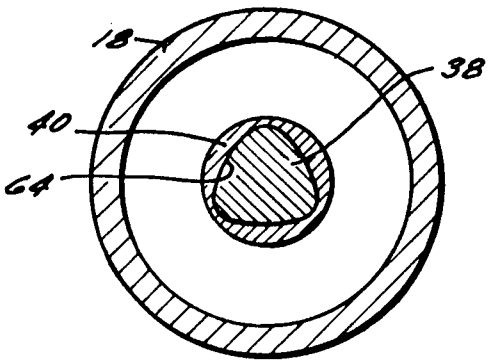
FIG. 5 shows a transverse cross sectional view taken along line 5—5 in FIG. 1.

Referring to FIGS. 1 and 5, drive shaft 42 includes an inner bore 60. Drive shaft cap 40 is threadably secured to drive shaft 42 and includes a passage 62 for allowing drilling fluid to flow from the housing 18 into bore 60 of drive shaft 42. The downhole end 38 of flexible shaft 34 comprises a three lobed male polygon and is received within a corresponding polygonal socket 64 defined by cap 40. Alternatively, the downhole end 38 of the shaft 34 may comprise a four lobed male polygon and socket 64 may comprise a corresponding four lobed polygonal socket. The flexible shaft 34 is secured to cap 40 by threaded extension 66 and nut 68.

Design Considerations

There are a number of design constraints for the flexible shaft 34, e.g. no buckling under simultaneous torque and thrust loads, a limit on upper radial bearing load, limits on bending, torsion and axial frequencies and a limit on the magnitude of stress fatigue factor of safety.

The dimensions of the flexible shaft 34 are determined primarily by fatigue considerations. The diameter of the flexible shaft 34 must be large enough to support very high steady torque loads while the length of the shaft 34 must be sufficient to reduce cyclic bending stresses to an acceptable level. In a preferred embodiment of the motor of the Present invention the flexible shaft 34 is run through a bored out rotor to minimize the length of the motor. The deflected shape of the flexible shaft 34 over the entire range of operating conditions, i.e. zero thrust to thrust at maximum flow stall, must not come into contact with the rotor anywhere along its length to avoid wear damage.

The loads transmitted by the flexible shaft 34 through its connections to the other elements of the motor must be reviewed to insure that the performance and/or endurance of the other elements of the motor are not adversely effected.

The flexible coupling of the present invention may be used in either a straight housing or a "bent" housing. Embodiments of the present invention having a "bent" housing are particularly useful in directional drilling operations in that the bent housing is steerable and facilitates correctional measures required to keep the drill bit on the desired course through the earth formation.

Figure 6:
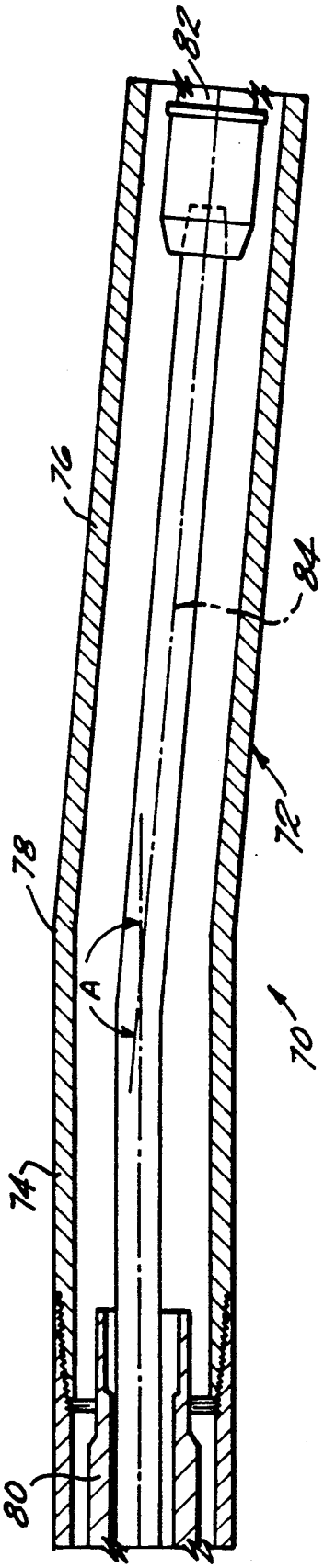
FIG. 6 shows a schematic cross sectional view of a drilling motor having a "straight" housing.

FIG. 6 shows a motor 70 having a "bent" housing 72, wherein the degree of bending is exaggerated for emphasis, which includes a rotor portion 74 extending along a first longitudinal axis, a drive shaft portion 76 extending along a second longitudinal axis and a transitional portion 78 connecting the first and second portions. A rotor 80 is disposed within the rotor portion 74 of housing 72, a drive shaft 82 is mounted within the drive shaft portion 76 of the housing 72. The rotor 80 and drive shaft 82 are coupled by flexible shaft 84 according to the present invention. The first and second longitudinal axes are noncolinear and intersect in the transitional portion 78. The intersecting first and second axes define an included angle "A" of more than about 177° and less than 180°, i.e. the second axis deviates from the first axis by an angle of up to about 3°. Preferably, the intersecting first and second axes define an included angle between about 178° and about 179.5°, i.e. the second axis deviates from the first axis by an angle between about 0.5° and about 2°.

Figure 7:
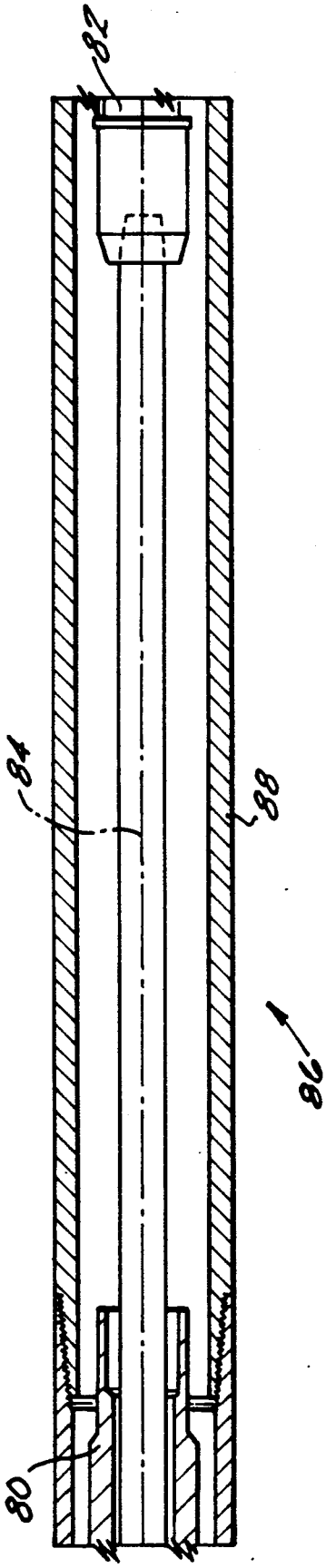
FIG. 7 shows a schematic cross sectional view of a drilling motor having a "bent" housing.

FIG. 7 shows a schematic cross sectional view of a drilling motor 86 with a straight housing for comparison with FIG. 6. Drilling motor 86 includes a straight housing 88, a rotor 80, a drive shaft 82 and a flexible shaft 84.

Figure 8:
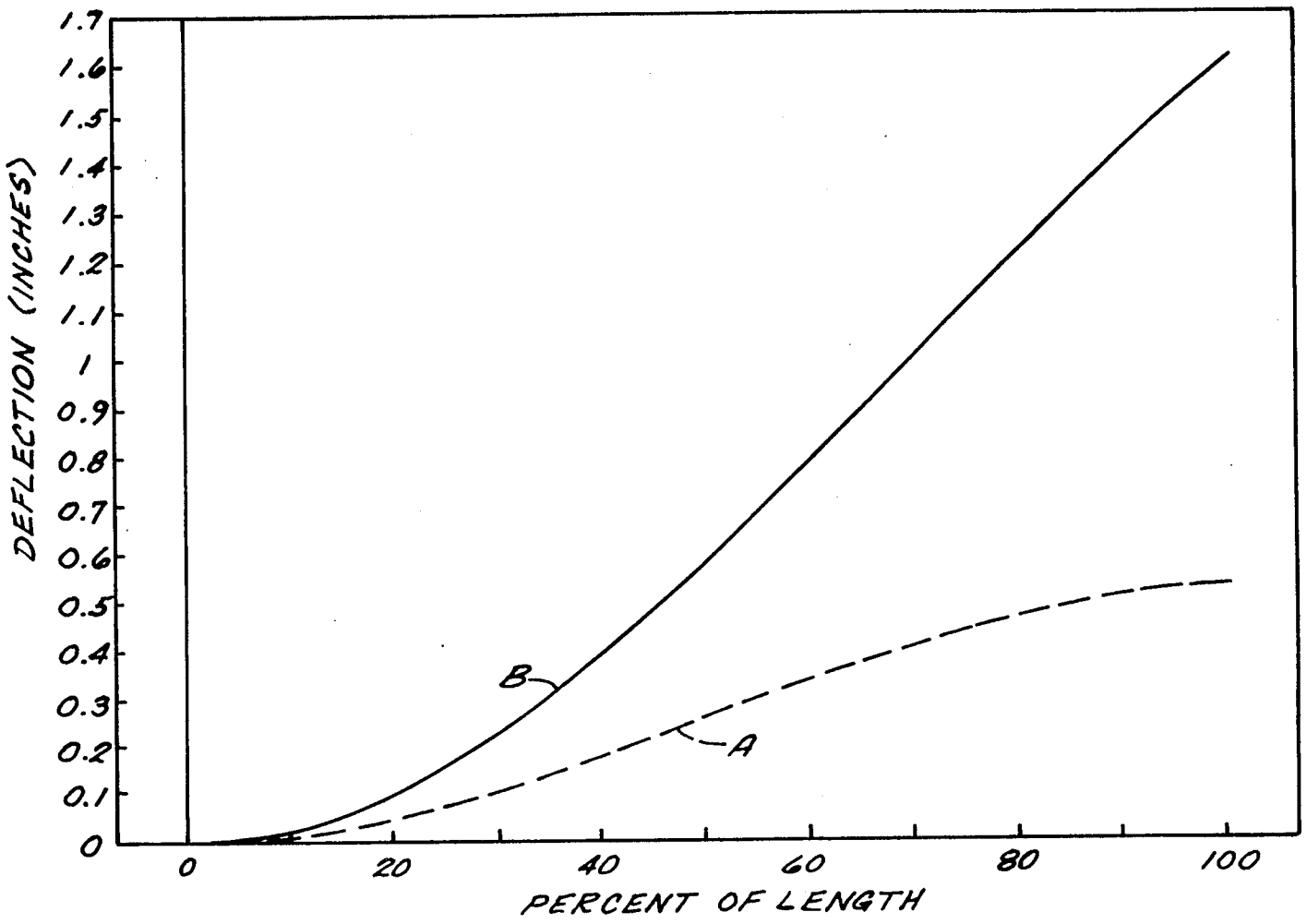
FIG. 8 shows a plot comparing maximum deflection for a flexible shaft in a straight housing and a flexible shaft in a bent housing versus percent of shaft length.

As implied by a comparison of FIGS. 6 and 7, a bent housing imposes more severe demands on a flexible shaft coupling than does a straight housing. FIG. 8 shows a graphical representation of the maximum deflection (in inches) from the central axis of the drive shaft end of a flexible shaft rotating in a straight housing (Line A) and of a flexible shaft rotating in a bent housing having a 1° bend (Line B). The X-axis of FIG. 8 shows position along the respective shaft as percent of length, i.e. A percentage of the distance from the concentrically rotating drive shaft connection of the shaft and the eccentrically rotating rotor connection of the shaft, starting from the drive shaft connection. The maximum deflection of the flexible shaft in the bent housing is several times the maximum deflection of the flexible shaft in a straight housing.

Figure 9:
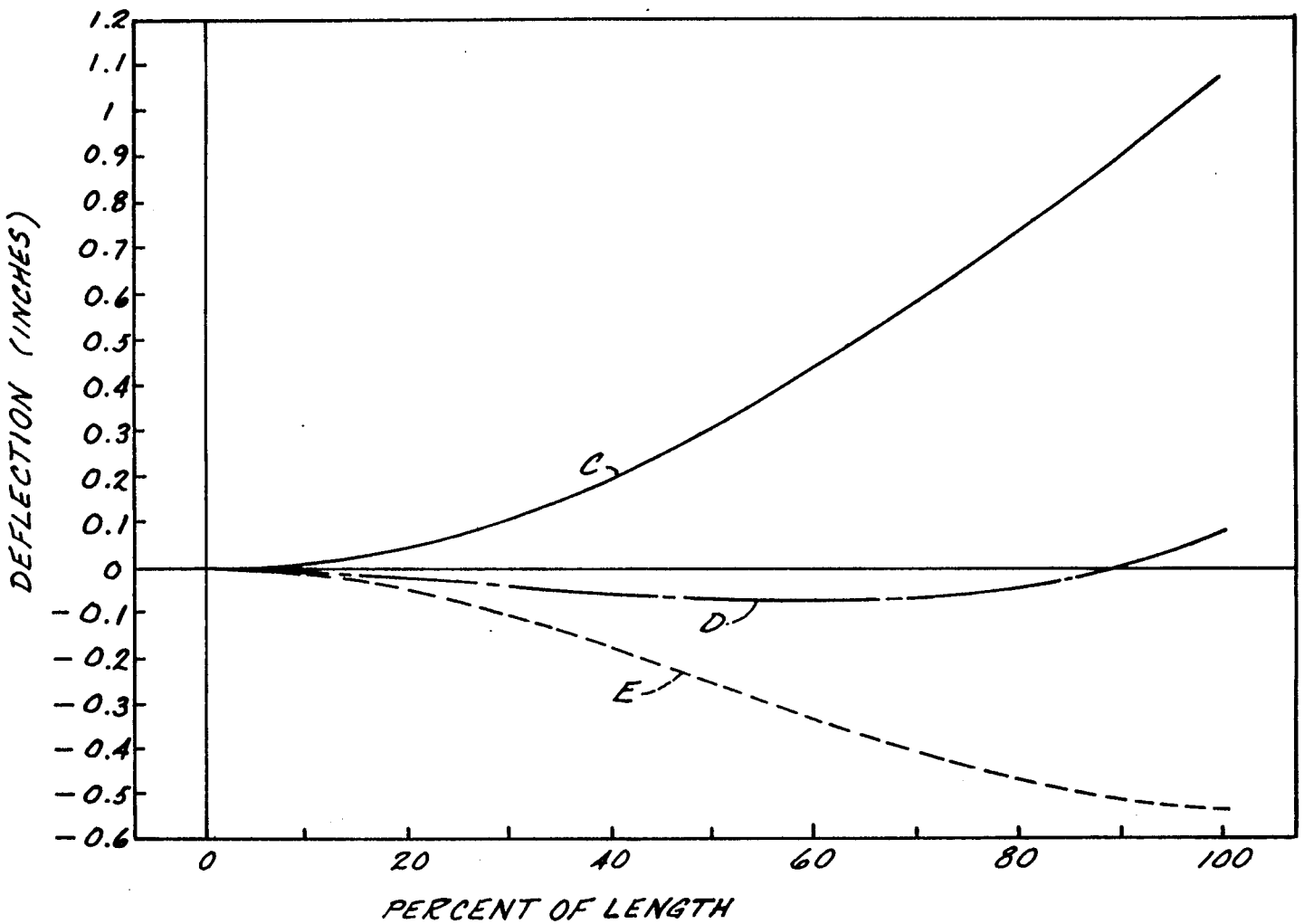
FIG. 9 shows plots of deflection of a flexible shaft in a bent housing in three different longitudinal planes.

FIG. 9 shows the complex deflected shape of the flexible shaft in a bent housing versus percent of length of the drive shaft end. Line C shows deflection of the shaft in a first plane, i.e. the plane of the bend in the housing. Line D shows deflection of the shaft in the plane normal to the first plane and LINE E shows deflection of the shaft in the plane bisecting the angle between the first and second planes.

EXAMPLE 1

A drilling motor of the present invention having an outer diameter of 9 $\frac{5}{8}$ inches was designed and built based on consideration of the above discussed constraints and design variables.

The motor includes a 79.25 inches long, 9 $\frac{5}{8}$ inches diameter 1° bent housing wherein the center of the bend, i.e. the point of the intersection of the two principal longitudinal axes of the housing, is disposed 57.54 inches from the downhole end of the housing.

A 135 inch long, 2.5 inch diameter 4140 alloy steel shaft was used as the flexible shaft. A 2 $\frac{1}{4}$ inch P3 male polygon was machined on each end of the flexible shaft and mating connections were provided on the rotor tail shaft and drive shaft cap.

Starting from the downhole end of the rotor a 3.554 inch bore was machined for a length of 26.875 inches, followed by a 3.40 inch bore for another 54.50 inches, stepped down to 2.55 inches for the full remaining length of the rotor. The rotor tailshaft was secured to the rotor and the cap was secured to the drive shaft with 8 TP1 3 $\frac{5}{8}$ inch threaded connections.

The factor of safety for infinite fatigue life of the flexible shaft is calculated using the R. E. Peterson equation for fluctuating normal and shear stresses, Burr, Arthur H., "Mechanical Analysis and Design", Elsevier, New York, NY 1981, page 226. The factor of safety for an infinite fatigue life is 1.8 or higher.

Values were calculated for both the rotor and drive shaft ends of the flexible shaft where the greatest stresses occur. The results are a value of 1.8 for the drive shaft end and a value of 1.92 for the rotor end.

The fundamental bending frequency of the shaft is calculated as f=24.74 hz.

EXAMPLE 2

The shaft and housing of Example 1 are replaced with a 100 inch long 2.5 inch diameter BeCu shaft and a correspondingly shortened housing. The BeCu shaft provides better corrosion resistance and higher flexibility than the 4140 steel shaft and allows the shorter length tool to perform at least as well as the tool of Example 1. Calculations of the factor of safety for infinite fatigue life of the BeCu flexible shaft provided values of 1.83 for the drive shaft end and 2.20 for the rotor end.

The flexible shaft of the drilling motor of the present invention compensates for the eccentric motion of the rotor while transferring power to the concentrically rotating drive shaft and compensates for the angular and lateral misalignments between the rotor and drive shaft produced by the bent housing of the present invention.

The flexible shaft of the drilling motor of the present invention transmits very heavy loads and provides an infinite fatigue life in a very hostile environment.

The flexible shaft of the drilling motor of the present invention may be machined from a single uniform diameter metal rod with minimal waste or manufactured by conventional filament winding composite material fabrication techniques.

The elements of the drilling motor of the present invention are interchangeable between motors.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A downhole drilling motor, comprising:

a housing, a stator secured within said housing and having a helically contoured internal surface.

a rotor disposed within said stator and having a helically contoured external surface, said rotor including a first tempered polygonal socket;

a drive shaft rotatably mounted within housing, said drive shaft including a polygonal socket;

a flexible shaft for connecting said drive shaft to said rotor and allowing eccentric movement of said rotor within said stator, said flexible shaft having first and second polygonal ends;

wherein said first polygonal end of said flexible shaft is received within the polygonal socket of said rotor and said second polygonal end of said flexible shaft is received with said polygonal socket on said drive shaft.

2. The motor of claim 1, wherein:

said first and second polygonal ends each comprise three symmetric lobes.

3. The motor of claim 1, wherein:

said first and second polygonal ends each comprise four symmetric lobes.

4. The motor of claim 1, wherein said housing includes a first portion extending along a first longitudinal axis, a second portion extending along a second longitudinal axis and a transitional portion connecting the first and second portions, said first and second axes being noncolinear and intersecting in said transitional portion.

5. The motor of claim 4, wherein the first and second axes define an included angle of greater than about 177° and less than about 180°.

6. The motor of claim 4, wherein the first and second axes define an included angle between about 178° and about 179.5°.

7. The motor of claim 1, wherein the flexible shaft comprises 4140 alloy steel.

8. The motor of claim 1, wherein the flexible shaft comprises a beryllium copper alloy.

9. The motor of claim 1, wherein the flexible shaft comprises a fiber reinforced polymer matrix composite material.

10. The motor of claim 1, wherein:

the rotor defines an internal bore extending from a open first end of the rotor to a closed second end of the rotor, said polygonal socket is defined by said closed second end and communicates with said bore; and said flexible shaft is received within said bore of said rotor.

11. The motor of claim 1, wherein the rotor defines an internal passage extending longitudinally from an open downhole end of the rotor to a closed uphole end of the rotor, and wherein the passage progressively widens from the uphole end to the downhole end to allow deflection of the flexible rod within the passage.

12. The motor of claim 11, wherein the motor further comprises resilient limit means, disposed around the open downhole end of the rotor, to prevent contact between the uphole end of the rotor and the flexible shaft.

13. The motor of claim 1, wherein said first and second polygonal ends comprises tapered polygonal ends and said polygonal sockets comprise tapered polygonal sockets.

14. The motor of claim 1, wherein the rotor defines an internal passage extending longitudinally from an open downhole end of the rotor to a closed uphole end of the rotor, and wherein the passage progressively widens from the uphole end to the downhole end to allow deflection of the flexible rod within the passage.

15. The motor of claim 14, wherein the motor further comprises resilient limit means, disposed around the open downhole end of the rotor, to prevent contact between the uphole end of the rotor and the flexible shaft.

16. A downhole drilling motor for directional drilling, comprising:

a housing, said housing having a first tubular portion extending along a first longitudinal axis, a second tubular portion extending along a second longitudinal axis and a transitional portion between the first and second tubular portions, said first and second longitudinal axes being noncolinear and intersecting in said transitional portion;

a stator secured within the first portion of the housing and having a helically contoured inner surface;

a rotor disposed within the stator and having a helically contoured external surface;

a drive shaft rotatably mounted within the second portion of the housing;

a flexible shaft for connecting the drive shaft to the rotor and allowing eccentric movement of the rotor within the stator; and wherein the rotor defines an internal bore extending from an open downhole end of the rotor to a closed uphole end of the rotor, said flexible shaft being received within the internal bore and secured to the closed uphole end of the rotor.

17. The motor of claim 16, wherein the first and second axes defined an included angle of greater than about 177° and less that about 180°.

18. The motor of claim 16, wherein the first and second axes defined an included angle between about 178° and about 179.5°.

* * * * *